US011253882B1

(12) United States Patent
Wise

(10) Patent No.: US 11,253,882 B1
(45) Date of Patent: Feb. 22, 2022

(54) SOLUTION DISPENSING DEVICE

(71) Applicant: Robert Wise, Penngrove, CA (US)

(72) Inventor: Robert Wise, Penngrove, CA (US)

( * ) Notice: Subject to any disclaimer, the term of this patent is extended or adjusted under 35 U.S.C. 154(b) by 0 days.

(21) Appl. No.: 17/018,691

(22) Filed: Sep. 11, 2020

(51) Int. Cl.
*B05B 11/00* (2006.01)

(52) U.S. Cl.
CPC ..... *B05B 11/3039* (2013.01); *B05B 11/0054* (2013.01); *B05B 11/3052* (2013.01)

(58) Field of Classification Search
CPC ..... B05B 11/3039; B05B 11/0054; B05B 11/3052; B05B 11/0078; B05B 11/0038; B05B 11/0081; B05B 7/0416; B05B 7/0425; B05B 7/2443; B05B 7/2454; B05B 7/28; B05B 7/262; B05B 7/267; B65D 81/3211; B65D 81/3222; B65D 81/325; B65D 81/3255; B67D 1/1288; B67D 1/0037; B67D 1/105
USPC ..... 222/383.1, 321.7, 129, 136, 130, 135, 222/226, 240, 190
See application file for complete search history.

(56) References Cited

U.S. PATENT DOCUMENTS 1,519,664 A * 12/1924 Campbell ..... F04D 1/12 222/240
1,845,429 A * 2/1932 Lorenz ..... F16N 13/00 184/27.2
1,930,872 A * 10/1933 Blackmun ..... B05B 11/307 239/355
1,956,788 A * 5/1934 Blum ..... B67D 1/0858 261/28
4,497,580 A * 2/1985 Doyel ..... B01F 7/1695 222/239
4,776,080 A * 10/1988 Christensen ..... B23P 19/10 269/903
5,255,851 A * 10/1993 Tobler ..... B05B 7/0037 222/190
5,890,624 A * 4/1999 Klima ..... B05B 11/0056 222/82
10,150,125 B2 * 12/2018 Bruder ..... B05B 11/3094
10,492,648 B1 * 12/2019 Pimentel ..... A47K 5/08
(Continued)

OTHER PUBLICATIONS

Presto! by Amazon: Refillable Cleaners Variety Starter Pack, (3 reusable spray bottles, 6 refill pacs), Refill, reuse, reduce https://www.amazon.com/Presto-Pacs-Refill-Variety-Pack/dp/B07ZHWN8N8/?th=1 Oct. 27, 2021.

*Primary Examiner* — Charles P. Cheyney
(74) *Attorney, Agent, or Firm* — Boudwin Intellectual Property; Daniel Boudwin

(57) ABSTRACT

A solution dispensing device includes a housing having an upper section and a lower section. The upper section is comprised of a push button exposed through the exterior of the upper section. The push button is movably connected to at least a first air chamber and at least one solution chamber. The solution chamber is in fluid communication with the solution reservoir and a discharge nozzle. The first air chamber is fluidly connected to the discharge nozzle. The push button is coupled to an elongated mixing rod that protrudes into the lower section. The lower section comprises an interior volume that functions as a solution reservoir. A solution mixer is rotatably coupled to the elongated mixing rod. Upon a press of the push button the solution in the solution chamber and the air in the at least a first air chamber will mix and exit the discharge nozzle.

17 Claims, 5 Drawing Sheets

(56) References Cited

U.S. PATENT DOCUMENTS

| | | | | |
|---|---|---|---|---|
| 2007/0000941 | A1* | 1/2007 | Hadden | A47K 5/1217 222/52 |
| 2012/0175383 | A1* | 7/2012 | Engels | B01F 7/00633 222/135 |
| 2015/0122835 | A1* | 5/2015 | Gonzalez | B65D 21/083 222/105 |

* cited by examiner

SOLUTION DISPENSING DEVICE

BACKGROUND OF THE INVENTION

The present invention relates to solution dispensing devices. More particularly, the present invention provides a refillable solution dispensing device.

Currently, many solution dispensers that produce a solution are placed into a can and dispensed with an aerosol product. These cans produce a large amount of waste. This waste is deposited in landfills to eventual one day break down. Even after the cans break down, the residual, potentially harmful interior material is then released into the soil or air. This can cause further damage to an area of land.

Traditional aerosol cans use dangerous gases to pressurize the cans. In some instances, these gases are only harmful to the overall environment. In other instances, these gases are poisonous to humans. These gases may cause damage to a body or even cause cancer. These gases may even be deadly if inhaled. The combination of gases and having sealed metal cans means that refilling these items is not an option.

Many times, solutions in these cans tend to separate over time. This means that the solutions to be ed often change in consistency overtime and become weaker. Many times, the instructions are to shake before use. This attempts to mix the solution to reduce the separation effects. This shaking is often unsuccessful and does not properly mix the solution.

Consequently, there is a need for an improvement in the art of solution dispensers. The present invention substantially diverges in design elements from the known art while at the same time solves many environmental issues with current dispensers. In this regard the present invention substantially fulfills these needs.

SUMMARY OF THE INVENTION

The present invention provides a solution dispensing device wherein the same can be utilized for providing convenience for the user when using a solution dispensing device. The solution dispensing device is comprised of a housing having an upper section and a lower section. The upper section is comprised of a push button exposed on the exterior of the upper section and is connected to an actuator body on the interior of the upper section. The actuator body is movably connected to at least a first air chamber and a at least one solution chamber. The at least one solution chamber is in fluid communication with the solution reservoir at one end and a discharge nozzle at another end. The first air chamber is fluidly connected to the discharge nozzle. The actuator body includes an elongated mixing rod that protrudes into the lower section. The lower section comprises and interior volume that functions as a solution reservoir. A solution mixer is rotatably coupled to the elongated mixing rod.

Another object of the solution dispensing device is to have a second air chamber affixed to the actuator body. The second air chamber is in fluid communication with the discharge nozzle.

Another object of the solution dispensing device is to have a protruding cylinder secured to the bottom of the actuator body. The protruding cylinder protrudes into the lower section.

Another object of the solution dispensing device is to have an output selector which extends through the upper section and is operably coupled to the at least one solution chamber. The output selector controls the amount of solution which exits the device on each.

Another object of the solution dispensing device is to have a first pressure adjustment knob secured to a lower side of the first air chamber. The first pressure adjustment knob controls the pressure of the first air chamber.

Another object of the solution dispensing device is to have a second pressure adjustment knob secured to a lower side of the second air chamber. The second pressure adjustment knob controls the pressure of the second air chamber.

Another object of the solution dispensing device is to have the upper section and the lower section which are removably secured together.

Another object of the solution dispensing device is to have an actuator body which further comprises a spring. The spring will return the actuator body to an extended position after a press of the push button.

Another object of the solution dispensing device is to have a protruding cylinder which houses the elongated mixing rod and the mixing device.

Another object of the solution dispensing device is to have an elongated mixing rod which is connected to the mixing device via threads. The threads cause the mixing device to rotate upon a press from the push button.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
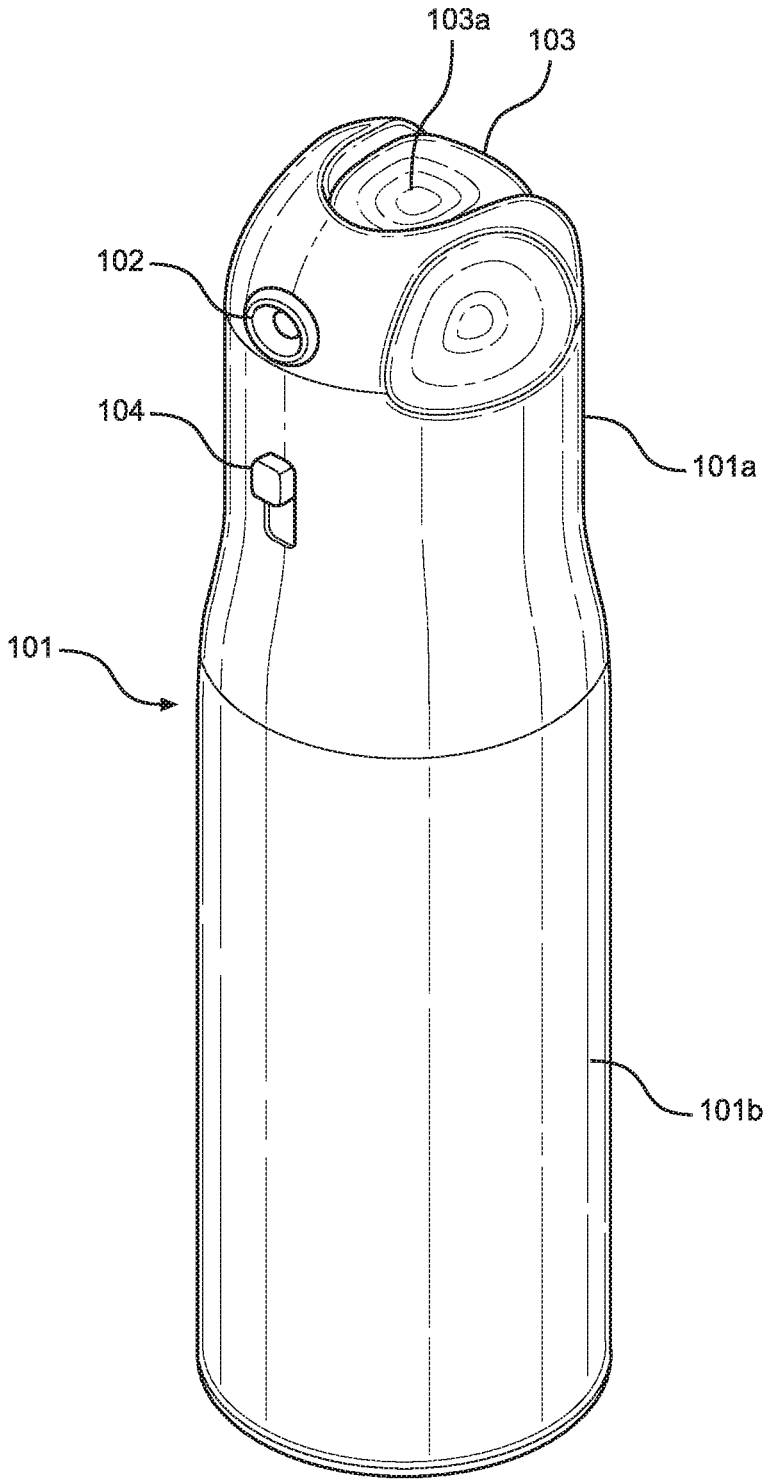
FIG. 1 shows a perspective view of an embodiment of the solution dispensing device.

Reference is made herein to the attached drawings. Like reference numerals are used throughout the drawings to depict like or similar elements of the solution dispensing device. For the purposes of presenting a brief and clear description of the present invention, a preferred embodiment will be discussed as used for the solution dispensing device. The figures are intended for representative purposes only and should not be considered to be limiting in any respect.

Referring now to FIG. 1, there is shown a perspective view of an embodiment of the solution dispensing device. The solution dispensing device is comprised of a housing 101 having an upper section 101*a* and a lower section 101*b*. The upper section 101*a* and the lower section 101*b* are secured together as will be described in the description of FIG. 2. In one embodiment, the housing 101 is a cylindrical housing. This will allow the device to be easily held in one hand. While other shapes are plausible as part of this disclosure, a cylinder is the most common for these articles.

In one embodiment, the housing 101 narrows toward a top end of the housing. This will allow for the lower section 101*b* to be larger than the top section 101*a*. The bigger lower section 101*b* allows for additional solution to be placed into the dispenser.

The upper section 101*a* includes a discharge nozzle 102 in fluid communication with the interior of the dispenser. The connections of the discharge nozzle 102 will be described in the description of FIG. 3 and FIG. 4. The discharge nozzle 102 will allow for the contents of the solution dispenser to be expelled from the device. In one embodiment, the discharge nozzle 102 has an adjustable output. In one embodiment, the discharge nozzle 102 will produce a stream flow. In another embodiment, the discharge nozzle 102 will produce a planar spay. In yet another embodiment, the discharge nozzle 102 will produce a cloud spray. In another embodiment, the discharge nozzle 102 will produce a steam of liquid.

In a further embodiment, the housing 101 has a push button 103 located on a top of the upper portion 101*a*. The push button 103 movably attached to an actuator housing as described in FIG. 3 and FIG. 4. The push button 103 is movable such that it enters the housing 101 when pushed toward the housing 101. In one embodiment, the push button 103 has a depression 103*a* thereon. This will allow a finger to be placed in the depression 103*a* and to remain fixed in position without sliding from the push button 103.

In one embodiment, the exterior of the housing 101 includes a solution volume adjuster 104. The solution volume adjuster 104 will control the amount of solution that is dispensed with each press of the push button 103. The solution volume adjuster 104 will be in contact with the dispensing devices as described in FIG. 3 and FIG. 4. In one embodiment, the solution volume adjuster 104 is a sliding knob that protrudes from the housing 101. In a further embodiment, the solution volume adjuster 104 is located through a channel 105 of the housing 101. In one embodiment, there are indicia located on the housing 101 adjacent to the solution volume adjuster 104, which will correspond to the amount of solution dispensed when the solution volume adjuster 104 is in a specific location.

Figure 2:
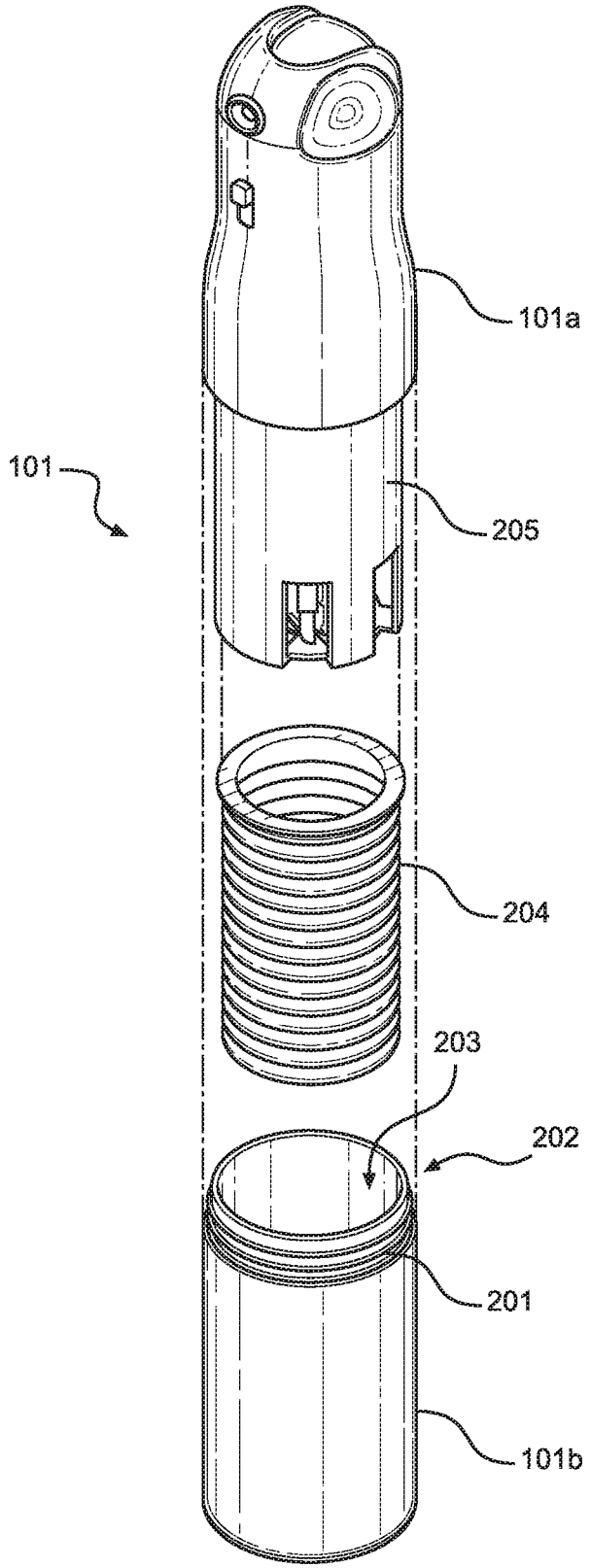
FIG. 2 shows a partially exploded view of an embodiment of the solution dispensing device.

Referring now to FIG. 2, there is shown a partially exploded view of an embodiment of the solution dispensing device. In this view, the upper section 101*a* of the housing 101 and the lower section 101*b* of the housing 101 are separated. In this embodiment, a threading 201 is shown about an upper edge 202 of the lower section 101*b*. The interior of the upper section 101*a* has a corresponding threading. This will allow the upper section 101*a* to be threaded onto the lower section 101*b*. In another embodiment, the upper section 101*a* and the lower section 101*b* have a snap connection.

The lower section 101*b* has an interior volume. In one embodiment, this interior volume functions as a solution reservoir 203. In another embodiment, there is an additional item located within the lower section which functions as a solution reservoir. The solution reservoir 203 will hold a liquid solution.

In one embodiment, the solution is poured directly into the solution reservoir 203. In another embodiment, a cartridge 204 is placed within the solution reservoir 203. In one embodiment, the cartridge 204 will hold the solution and the solution will be ed from the cartridge 204. In one embodiment, the cartridge 204 is made from plastic. In another embodiment, the cartridge 204 is made from polyvinyl alcohol.

In another embodiment, the upper section 101*a* includes a protrusion 205. In one embodiment, the protrusion 205 is a cylindrical protrusion. The protrusion 205 will fit within the lower section 101*b* when the upper housing 101*a* is secured thereto. In one embodiment, the protrusion 205 will crush the cartridge, thereby expelling the solution into the solution reservoir 203. In one embodiment, the cartridge 204 comprises a plurality of pleats therein, defining an accordion shape. This will allow for the cartridge 204 to properly collapse to dispense the solution.

Figure 3:
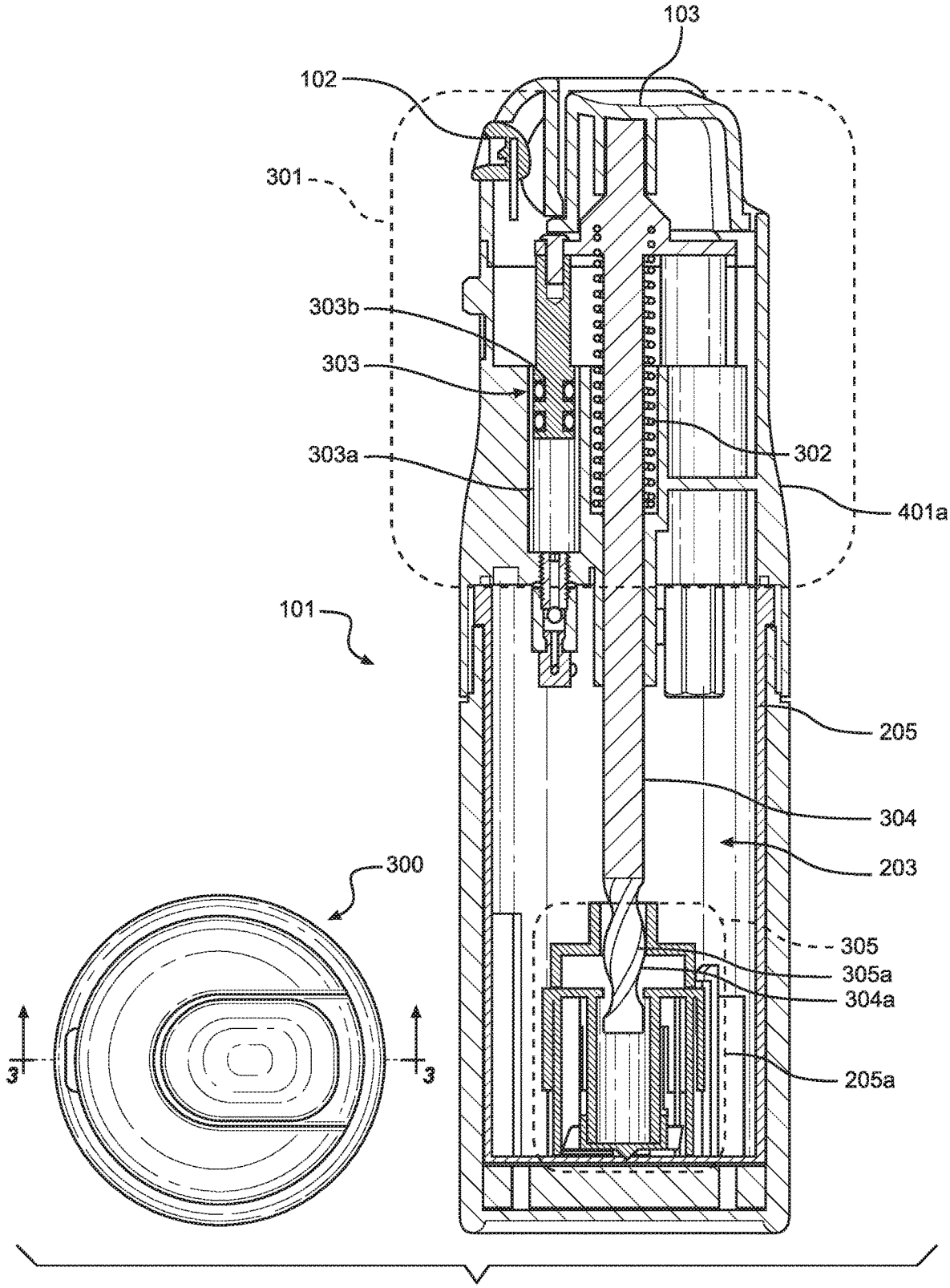
FIG. 3 shows a cross-sectional view of an embodiment of the solution dispensing device.

Referring now to FIG. 3, there is shown a cross-sectional view of an embodiment of the solution dispensing device. Please also see FIG. 5 in coordination with FIG. 3. The solution dispensing device includes an actuator body 301. The actuator body 301 is coupled to the push button 103. When the push button 103 is depressed the actuator body 301 is moved along with the push button 103. In one embodiment, at least one spring 302 is included as part of the actuator body 301. The at least one spring 302 will bias the actuator body 301 toward the top of the device. This will allow the push button 103 and the actuator body 301 to reset to an extended position after pressed into a retracted position.

The solution dispensing device includes a at least one solution chamber 303. The at least one solution chamber 303 is comprised of a solution housing 303*a* and a piston 303*b*. The at least one solution chamber 303 is secured to the actuator body 301 at one end and the housing 101 at another end. This will allow the piston 303*b* to be depressed and reset along with the actuator body 301. The at least one solution chamber 303 is in fluid communication with the discharge nozzle 102. This is represented by hose 501 in FIG. 5. One of ordinary skill in the art will recognize that the hose is flexible and will not impede the movement of the push button 103. When the piston 303*a* is depressed, the solution exits the at least one solution chamber 303 and is ed form the discharge nozzle 102. The at least one solution chamber 303 is further in fluid communication with the solution reservoir 203. When the piston 303*b* is extended out of the solution housing 303*a*, the solution housing 303*a* fills with solution. There is a one way valve that will prevent the solution for re-entering the solution reservoir 203 when the piston 303*b* is depressed. In one embodiment the piston 303*a* creates a seal with the solution housing 303*b*. This will create the suction needed to draw solution from the solution reservoir 203 into the solution housing 303*b*.

The at least one solution chamber 303 includes a one way valve secured to the solution housing 303*a*. The one way valve will allow solution to be sucked into the solution housing 303*a* from the solution reservoir 203. The one way valve will further prevent solution from being dispelled back into the solution reservoir 203. The at least one solution chamber 303 will further include a pressure valve. The pressure valve will open once the solution reaches a predetermined pressure within the solution housing 303*a*, releasing the solution to the discharge nozzle 102.

In one embodiment, the actuator body 301 includes an elongated mixing rod 304. The elongated mixing rod 304 moves with the actuator body 301. The elongated mixing rod 304 is of a length that allows it to enter the lower section 101*b* of the housing 101 when the upper section 101*a* and the lower section 101*b* are secured together. In one embodiment, the elongated mixing rod 304 serves to hold the at least one spring 302 in place and allows it to properly push the actuator body 301 toward the top of the housing 101. In different embodiments the spring is not located around the mixing rod 304. For example, in one embodiment the is a plurality of springs 302 located around the interior perimeter of the push button 102. The elongated mixing rod 304 is further secured to a mixing device 305. In one embodiment, the mixing device 305 is secured to an end of the elongated mixing rod 304. The mixing device 305 will mix the solution within the solution reservoir 203.

In one embodiment, the elongated mixing rod 304 is movably secured to the mixing device 305. In one embodiment, the elongated mixing rod 304 has a threaded end 304*a*. The mixing device 305 has a corresponding threading 305*a*. When the elongated mixing rod 304 enters the mixing device 305 as the push button 103 is depressed, the mixing device 305 will spin. In one embodiment, the threaded end 304*a* of the elongated mixing rod 304 and the corresponding threading 305*a* of the mixing device 305 will disengage when the actuator body 301 is in the extended position. This will allow the mixing device 305 to continue spinning after each depression of the push button 103.

In one embodiment, the elongated mixing rod 304 is extended into the protrusion 205 of the upper section 101*a*. Further, in one embodiment, the mixing device 305 is rotatably secured within the protrusion 205. In another embodiment, the protrusion 205 includes a housing 205*a* which will secure the mixing device. This will ensure that the mixing device 305 will stay at a lower section of the solution reservoir 203 to adequately mix the solution.

The activation of the mixing device 305 on the depression of the actuator body 301 will have additional benefits. The solution enters the at least one solution chamber 303 when the actuator body 301 is extended. This means that already mixed solution will enter the at least one solution chamber 303. This ensures that each time solution is dispensed the is an evenly mixed solution. This further ensures that the solution does not dilute throughout the use of the dispenser.

In one embodiment the dispensing device includes additional solution chambers. The additional solution chambers are configured similar to the at least one solution chamber described above. Each additional chamber will be fluidly connected to a solution reservoir and the discharge nozzle 102. Further, each additional solution chamber will be connected to the push button 103 and the housing 101. In one embodiment the additional solution chambers are of different volumes. This will allow for different solutions to be mixed together creating one discharge. In another embodiment the solution chambers are connected to separate solution reservoirs. This will allow for different mixtures to be created.

Figure 4:
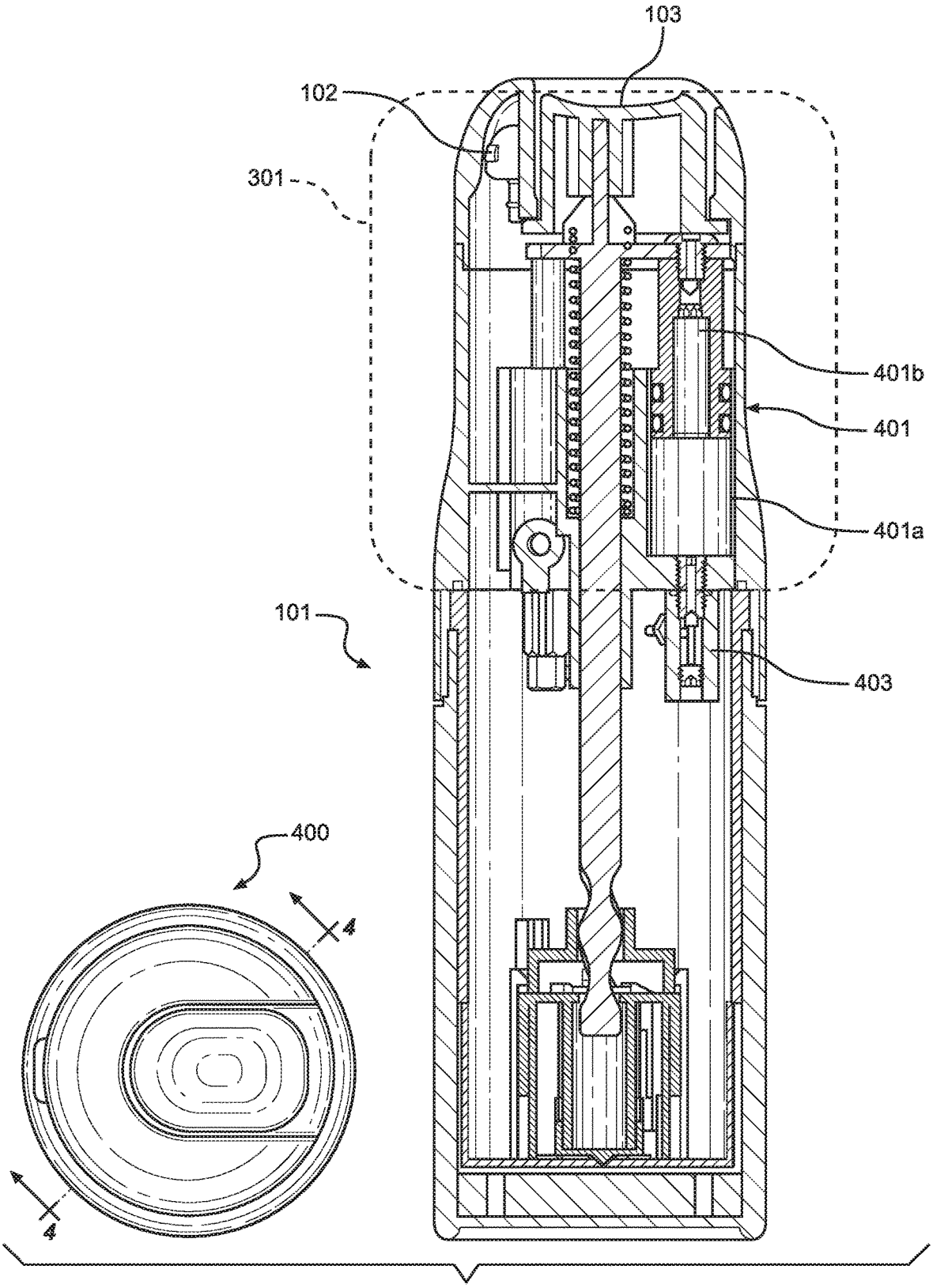
FIG. 4 shows a cross-sectional view of an embodiment of the solution dispensing device.

Referring now to FIG. 4, there is shown a cross-sectional view of an embodiment of the solution dispensing device. Please also see FIG. 5 in coordination with FIG. 4. The solution dispensing device includes a first air chamber 401. The first air chamber 401 is comprised of an air housing 401*a* and a piston 401*b*. The first air chamber 401 is secured to the actuator body 301 at one end and the housing 101 at another end. This will allow the piston 401*b* to be depressed and reset along with the actuator body 301. The first air chamber 401 is in fluid communication with the discharge nozzle 102. This is represented by hose 501 in FIG. 5. One of ordinary skill in the art will recognize that the hose is flexible and will not impede the movement of the push button 103. When the piston 401*a* is depressed the air is forced from the air chamber 401 and is ed form the discharge nozzle 102. When the piston 401*b* is extended out of the first air chamber 401, the first air housing 401*a* fills with air. There is a one way valve that will prevent the air from exiting the piston the way it came in when the piston 401*b* is depressed.

The air housing 401*a* of the first air chamber 401 has an air volume adjuster 403 secured thereto. This will allow for the volume of the air housing 401*b* to be increased or decreased. This will determine the pressure at which the solution will be ed from the device. In one embodiment, the air volume adjuster 403 is a turn knob which will rise and lower the base of the air housing 401*b*.

In some embodiments the first air chamber 401 includes a one way valve secured to the air housing 401*a*. The one way valve will allow air to be sucked into the air housing 401*a*. The one way valve will further prevent air from being dispelled through the same valve. In another embodiment the air housing 401*a* will further include a pressure valve. The pressure valve will open once the air within the air housing 401*a* reaches a predetermined pressure, releasing the air to the discharge nozzle 102.

Figure 5:
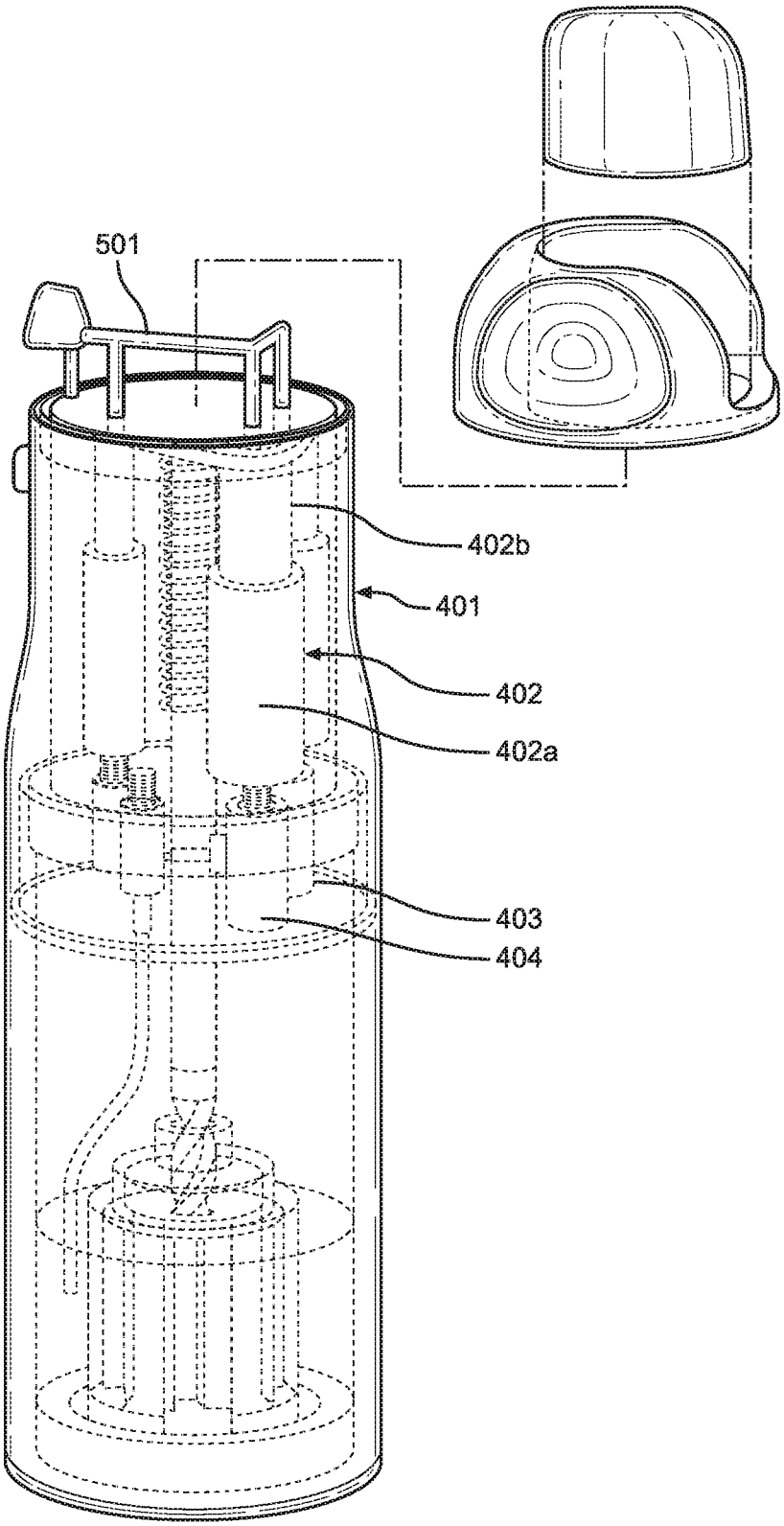
FIG. 5 shows a perspective view of an embodiment of the solution dispensing device.

In a further embodiment, seen specifically in FIG. 5, the solution dispensing device includes a second air chamber 402. The second air chamber 402 is comprised of an air housing 402*a* and a piston 402*b*. The second air chamber 402 is secured to the actuator body 301 at one end and the housing 101 at another end. This will allow the piston 402*b* to be depressed and reset along with the actuator body 301, the second air chamber 402 is in fluid communication with the discharge nozzle 102. This is represented by hose 501 in FIG. 5. One of ordinary skill in the art will recognize that the hose is flexible and will not impede the movement of the push button 103. When the piston 402*a* is depressed the air is forced from the air chamber 402 and air is ed form the discharge nozzle 102. When the piston 402*b* is extended out of the second air chamber 402, the second air housing 402*a* fills with air. There is a one way valve that will prevent the air from exiting the air chamber 402 the way it came in when the piston 402*b* is depressed.

The air housing 402*a* of the second air chamber 402 has an air volume adjuster 404 secured thereto. This will allow for the volume of the air housing 402*b* to be increased or decreased. This will determine the pressure at which the solution will be ed from the device. In one embodiment the air volume adjuster 404 is a turn knob which will rise and lower the base of the air housing 402*a*.

In some embodiments the first second chamber 402 includes a one way valve secured to the air housing 402*a*. The one way valve will allow air to be sucked into the air housing 402*a*. The one way valve will further prevent air from being dispelled through the same valve. In another embodiment the air chamber 402*a* will further include a pressure valve. The pressure valve will open once the air within the air chamber 402*a* reaches a predetermined pressure, releasing the air to the discharge nozzle 102.

In this embodiment, the first air chamber 401 and the second air chamber 402 work together. In one embodiment, this will allow the solution to be ed from the dispenser with a greater pressure. In another embodiment, this will allow for less stress to be put on each air chamber 401, 402. In yet a further embodiment, the dual air chambers 401, 402 will allow for redundancy. This means that even if one were to fail, the other could take its place. This would allow the dispenser to still function even if an air chamber becomes damaged.

When the push button 103 is depressed air and varying solutions are mixed together in the fluid connects between the respective chambers and the discharge nozzle, as represented by 501. This will allow for the solution to be dispensed in a number of different ways. Further, in some embodiments this will allow for different solutions to be mixed before exiting the discharge nozzle 102.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A solution dispensing device, the device comprising:

a housing having an upper section and a lower section that seal when coupled;

the lower section comprises and interior volume that functions as a refill solution reservoir;

the upper section is comprised of an actuator mechanism movably exposed through the exterior of the upper section and is coupled to at least an air and solution chamber within the upper section;

wherein the actuator mechanism will move into at least the air and solution chamber in the upper section;

the air and solution chamber in fluid communication with the refill solution reservoir and a discharge nozzle;

the actuator mechanism coupled to an elongated mixing apparatus that protrudes into the refill solution reservoir of the lower section;

a mixer coupled to the elongated mixing apparatus;

wherein the elongated mixing apparatus is moveably connected to the mixer via threads, wherein the threads cause the mixer to rotate when the actuator mechanism is activated;

wherein the actuator mechanism is configured to mix the contents of the refill solution reservoir when the actuator mechanism is activated, such that a resulting mixed solution is drawn into at least an air and solution chamber and readied for dispensation through the discharge nozzle.

2. The solution dispensing device of claim 1, further comprising one or more secondary air chambers disposed within the upper section of the housing and coupled to the actuator mechanism, wherein the one or more secondary chambers are in fluid communication with the discharge nozzle.

3. The solution dispensing device of claim 1, further comprising varied pressure controls between multiple air and solution chambers so to dispense the mixed solution at a prescribed pressure through the discharge nozzle.

4. The solution dispensing device of claim 1, the actuator mechanism comprising a push button and an output selector; the output selector extends through the upper section and is operably coupled to the at least one air or solution chamber;

the output selector controls the amount of solution which exits the device on each press of the push button that is operably connected to the actuator mechanism.

5. The solution dispensing device of claim 1, wherein the refill solution reservoir is configured to receive a concentrate solution refill cartridge.

6. The solution dispensing device of claim 5, wherein the solution cartridge is created from a composite mixture containing at least material selected from the group of polyvinyl alcohol or plastic or cellulose pulp or organic matter.

7. The solution dispensing device of claim 6, wherein the concentrate solution refill cartridge includes a concentrated solution in which both dissolves into a diluted solution when water is added to the refill solution reservoir.

8. The solution dispensing device of claim 1, wherein the actuator mechanism further comprises a push button and at least one spring which will return the push button to an extended position after a press of the push button.

9. The solution dispenser device of claim 7, wherein the concentrate solution refill cartridge is compressible, such that the concentrate solution refill cartridge compresses when inserted into the refill solution reservoir for ease of removing after releasing a mixed solution from within into refill solution reservoir.

10. The solution dispensing device of claim 9, wherein the lower section receives the refill solution cartridge and is configured to release the contents of the refill solution cartridge as the upper section and lower section are coupled together.

11. The solution dispensing device of claim 4, wherein the air chamber or the solution chamber includes guide elements configured to ensure smooth operation of the actuator mechanism and the elongated mixing rod when the actuator mechanism is depressed.

12. The solution dispensing device of claim 1, wherein the air and solution chambers include guide elements configured to ensure smooth operation of the movement of the mixing apparatus coupled to the actuator mechanism when the actuator mechanism is engaged.

13. The solution dispensing device of claim 1, wherein the air and solution chambers are configured to be adjustable in either diameter or length so to be adjusted to dispense varied types and quantities of solutions.

14. The solution dispensing device of claim 1, wherein the discharge nozzle has various configurations so to vary the pressure or duration of a discharge pattern of a dispensed solution.

15. The solution dispensing device of claim 1, where upon activating the actuator mechanism the solution mixer is configured to mix the concentrate solution within the concentrate solution refill cartridge such that the water dissolving the refill cartridge, the concentrate solution, and water added to the refill solution reservoir combine into the mixed solution, wherein the mixed solution is drawn into at least an air and solution chambers in a prescribed volume.

16. The solution dispensing device of claim 15, wherein the prescribed volume of mixed solution is held in the air or solution chambers or the solution dispensing reservoir or a combination thereof at a prescribed pressure, such that it is ready to be dispensed.

17. The solution dispensing device of claim 15, wherein the prescribed volume of solution is held in at least an air and solution chamber ready to be dispensed at a prescribed pressure upon activation of the actuator mechanism.

* * * * *